US006802106B2

(12) United States Patent
Taglianetti

(10) Patent No.: US 6,802,106 B2
(45) Date of Patent: Oct. 12, 2004

(54) CLAMP ON ADJUSTABLE MALE HINGE

(76) Inventor: Edward Taglianetti, 181 Ryan Rd., Marlboro, NJ (US) 07746

( * ) Notice: Subject to any disclaimer, the term of this patent is extended or adjusted under 35 U.S.C. 154(b) by 0 days.

(21) Appl. No.: 10/154,085

(22) Filed: May 24, 2002

(65) Prior Publication Data

US 2003/0217435 A1 Nov. 27, 2003

(51) Int. Cl.[7] ..... E05D 7/04

(52) U.S. Cl. ..... 16/246; 16/245; 16/252; 16/238; 16/268

(58) Field of Search ..... 16/246, 245, 244, 16/243, 240, 236, 252, 253, 238, 268, 86.1, 86.2, 389, 390; 49/381, 382; 256/21, 26, 54

(56) References Cited

U.S. PATENT DOCUMENTS

| | | | | | |
|---|---|---|---|---|---|
| 211,657 | A | * | 1/1879 | Herzog | 256/21 |
| 527,685 | A | * | 10/1894 | Haege | 16/240 |
| 1,316,473 | A | * | 9/1919 | Adeling | 16/253 |
| 1,983,125 | A | * | 12/1934 | Ellison | 16/236 |
| 3,107,390 | A | * | 10/1963 | Shelton | 16/224 |
| 3,514,807 | A | * | 6/1970 | Triplett | 16/253 |
| 3,811,149 | A | * | 5/1974 | Griffin | 16/240 |
| 4,047,332 | A | * | 9/1977 | Benoit | 49/236 |
| 4,141,109 | A | * | 2/1979 | Farrell | 16/237 |
| 4,330,901 | A | * | 5/1982 | Sanders | 16/237 |
| 5,669,105 | A | * | 9/1997 | Depke | 16/245 |
| 6,073,396 | A | * | 6/2000 | Kietzmann | 49/381 |

FOREIGN PATENT DOCUMENTS

| | | | |
|---|---|---|---|
| FR | 2455157 | * | 4/1979 |
| WO | WO 92/04520 | * | 3/1992 |

* cited by examiner

*Primary Examiner*—Chuck Y. Mah
(74) *Attorney, Agent, or Firm*—Hoffmann & Baron, LLP

(57) ABSTRACT

A two-part adjustable hinge is provided that is used in place of a standard gate hinge on a fence. The nut with attached pin can be adjusted upon the threads of the bolt attached to the clamp to change distance between the post and the gate without installation of new materials.

5 Claims, 5 Drawing Sheets

AJUSTA-HINGE

CLAMP ON AJUSTABLE HINGE

FRONT VIEW

AJUSTA-HINGE

CLAMP ON AJUSTABLE HINGE

SIDE VIEW

AJUSTA-HINGE

CLAMP ON AJUSTABLE HINGE

FRONTVIEW

AJUSTA-HINGE

CLAMP ON AJUSTABLE HINGE

AJUSTA-HINGE

CLAMP ON ADJUSTABLE MALE HINGE

FIELD OF THE INVENTION

The present invention relates to fences used to surround land, and more specifically, to equipment used to connect a gate to a fence post.

BACKGROUND OF THE INVENTION

Most fences surrounding land will have a gate to allow passage through the fence. During the construction of the fence, it is sometimes revealed that the standard hardware used to connect the gate to a fence post are not appropriately sized, resulting in the need to either remanufacture the gate or to move the post. This may be due to irregular calculations, defects or differences in the manufacture of the gate, or simply any other application that the standard hardware will not support. Rectifying these circumstances can be both costly and difficult; by the time the gate is attached to the post, the post has already been secured to the ground with concrete.

SUMMARY OF THE INVENTION

In light of the above, it is the object of the present invention to facilitate the connection of the gate to the fence post in these irregular circumstances.

The standard post clamp has been modified by the addition of a threaded bolt. The post clamp is attached to the post with a conventional bolt and nut.

A nut, modified by the addition of a smooth, round pin, is threaded upon the bolt and turned until the desired distance is achieved.

Then, the standard female bracket, attached to the gate, is mounted upon the round pin. The gate will swing on this pin.

As the nut with attached pin is adjustable upon the thread, the distance between the gate and the post can be varied without any difficulty.

DETAILED DESCRIPTION OF THE INVENTION

Figure 4:
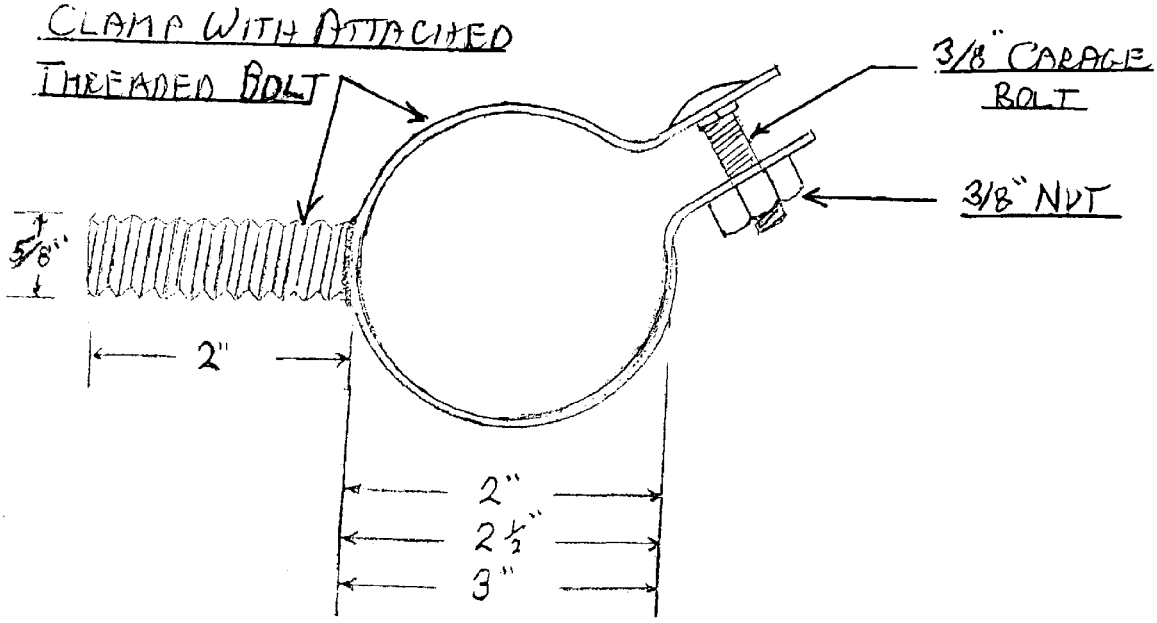
FIG. 4. is a front view of the clamp with attached threaded bolt.
Figure 5:
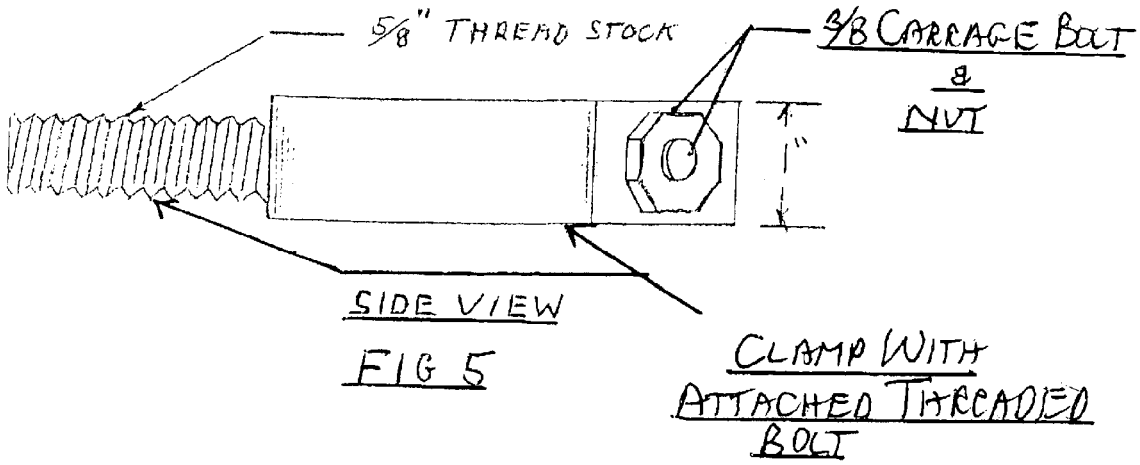
FIG. 5. is a side view of the clamp with attached threaded bolt.

The standard post clamp shown in FIG. 4. has been modified by the addition of a threaded bolt. As indicated in the drawing, it is anticipated that clamps will be offered in several different sizes to accommodate different-sized posts. The post clamp is attached to the post with a conventional bolt and nut.

Figure 2:
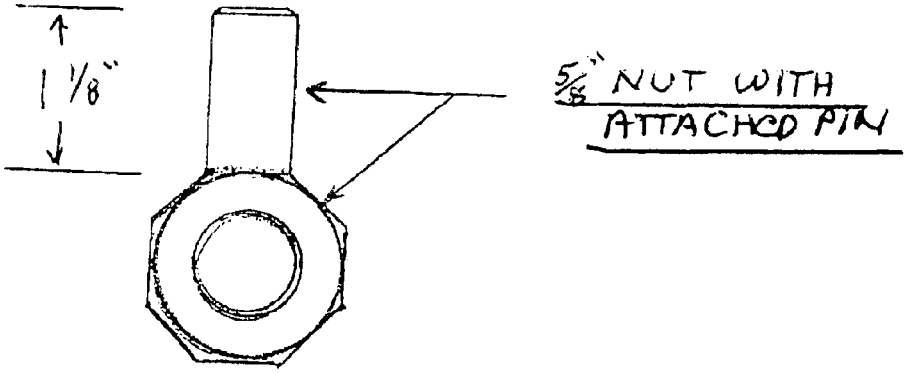
FIG. 2. is a front view of the nut with attached round pin.
Figure 3:
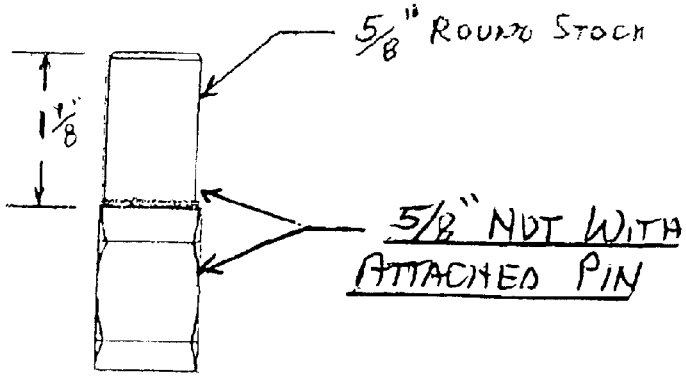
FIG. 3. is a side view of the nut with attached round pin.

A nut, indicated in FIG. 2. has been modified by the addition of a smooth, round pin is threaded upon the bolt and turned until the desired distance is achieved.

Figure 1:
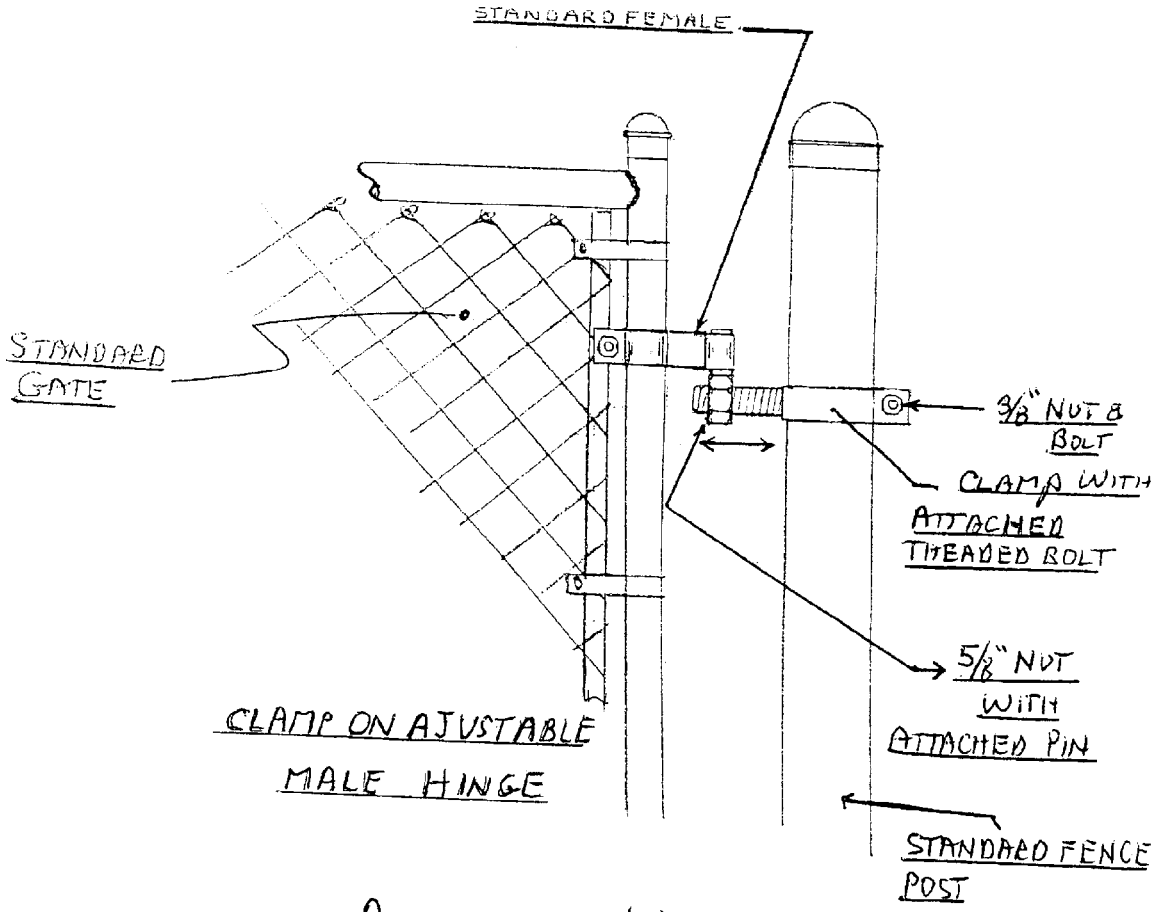
FIG. 1. is a perspective view of the invention as it is intended to be installed, showing all parts, according to an embodiment of the present invention.

Then, the standard female bracket, attached to the gate and shown in FIG. 1. is mounted upon the round pin. The gate will swing on this pin.

As the nut with attached pin is adjustable upon the thread, the distance between the gate and the post can be varied without any difficulty.

It is anticipated that two or more such apparatuses will be used in connection with any one gate.

The foregoing is illustrative of the present invention and is not to be construed as limiting thereof. Although a few exemplary embodiments of this invention have been described, those skilled in the art will readily appreciate that many modifications are possible without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the claims, with equivalents of the claims to be included therein.

What is claimed is:

1. An apparatus for attaching a fence post to a fence gate, comprising:

a clamp with attached threaded bolt that is adapted to be secured to an existing fence post using a conventional bolt and nut; and a nut with attached round stock pin, wherein the nut is threaded upon the aforementioned clamp and a standard female gate bracket, adapted to be attached to an existing gate, said female gate bracket will slide and rest upon the round stock pin.

2. An adjustable hinge for attaching a fence post to fence gate comprising:

a clamp adapted to be secured to a fence post, the clamp including a pin extending substantially perpendicular to the fence post;

a connector including a post adjustably mounted to the clamp pin; and a gate bracket adapted to be secured to a fence gate, the gate bracket including means to receive the connector post whereby the distance between the fence post and fence gate is adjustable by selectively positioning the connector on the clamp pin.

3. An adjustable hinge as defined in claim 1, wherein the clamp pin is threaded and the connector comprises a nut threadably received by said clamp pin, said post secured to the nut to extend substantially perpendicular to the threaded clamp pin.

4. A method of adjusting the distance between a fence post and a fence gate, wherein the fence post has secured thereto a clamp including a pin extending substantially perpendicular to the fence post, an adjustable connector including a post is movably mounted to the clamp pin, and wherein a gate bracket is secured to the fence gate, the gate bracket including a means to receive the connector post, the method comprising the step of:

adjusting the connector along the length of the clamp pin to thereby adjust the distance between a fence post and fence gate.

5. The method of adjusting the distance between a fence post and a fence gate as defined in claim 4, wherein the clamp pin is threaded and the connector comprises a threaded nut with said post extending from the periphery thereof, wherein the adjusting step further comprises threading the nut onto the clamp pin.

* * * * *